US009597898B2

(12) United States Patent
Gracia Verdugo et al.

(10) Patent No.: US 9,597,898 B2
(45) Date of Patent: Mar. 21, 2017

(54) METHOD AND APPARATUS FOR CONTROLLING INK CURING

(71) Applicants: HEWLETT-PACKARD DEVELOPMENT COMPANY L.P., Houston, TX (US); Antonio Gracia Verdugo, Sant Cugat del Valles (ES); Oriol Borrell Avila, Sant Cugat del Valles (ES); Ana Maria Cardells Tormo, Sant Cugat del Valles (ES)

(72) Inventors: Antonio Gracia Verdugo, Barcelona (ES); Oriol Borrell Avila, Sant Cugat del Valles (ES); Ana Maria Cardells Tormo, Sant Cugat del Valles (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/762,797

(22) PCT Filed: Jan. 25, 2013

(86) PCT No.: PCT/EP2013/051482
§ 371 (c)(1),
(2) Date: Jul. 22, 2015

(87) PCT Pub. No.: WO2014/114350
PCT Pub. Date: Jul. 31, 2014

(65) Prior Publication Data
US 2015/0367652 A1 Dec. 24, 2015

(51) Int. Cl.
*B41J 11/00* (2006.01)

(52) U.S. Cl.
CPC ..... *B41J 11/002* (2013.01)

(58) Field of Classification Search
None
See application file for complete search history.

(56) References Cited

U.S. PATENT DOCUMENTS

| | | | |
|---|---|---|---|
| 5,214,442 | A | 5/1993 | Roller |
| 6,428,160 | B2 | 8/2002 | Roy et al. |

(Continued)

FOREIGN PATENT DOCUMENTS

| | | |
|---|---|---|
| CN | 1798656 | 7/2006 |
| CN | 102179999 | 9/2011 |
| EP | 1974918 | 3/2008 |

OTHER PUBLICATIONS

Direct Thermal and Thermal Transfer Book, The Biofore Company, Jul. 18, 2011, 14 pages.

(Continued)

*Primary Examiner* — Bradley Thies
(74) *Attorney, Agent, or Firm* — HP Inc Patent Department

(57) ABSTRACT

A printing device (200) and method for controlling the curing of ink are described. An example printing apparatus has a printing module (230) with at least one printhead for printing a swath of a printed image and a print controller (220) arranged to generate image and print control data for a plurality of swaths. A curing module (270) is arranged to receive, for each of the plurality of one or more swaths, image and print control data and to control, before a printed region of the print medium (250) corresponding to a particular one or more swaths arrives, one or more operating parameters of the curing module (270) based on data values within said image data and printing parameters within said print control data.

25 Claims, 7 Drawing Sheets

(56) References Cited

U.S. PATENT DOCUMENTS

| | | | | |
|---|---|---|---|---|
| 6,836,626 | B2 * | 12/2004 | Hooper | G03G 15/2039 399/69 |
| 7,180,532 | B2 | 2/2007 | Slattery et al. | |
| 2004/0056940 | A1 | 3/2004 | Rutland et al. | |
| 2006/0001721 | A1 * | 1/2006 | Yraceburu | B41J 11/002 347/102 |
| 2009/0085998 | A1 * | 4/2009 | Kubota | B41J 11/002 347/102 |
| 2009/0122098 | A1 * | 5/2009 | Shindo | B41J 11/02 347/17 |
| 2010/0045721 | A1 | 2/2010 | Schaum et al. | |
| 2011/0128319 | A1 * | 6/2011 | Mitsuzawa | B41J 11/002 347/16 |
| 2012/0287196 | A1 * | 11/2012 | Boland | B41J 11/002 347/16 |

OTHER PUBLICATIONS

International Search Report, European Patent Office, Oct. 30, 2013. PCT Patent Application No. PCT/EP2013/051482.

* cited by examiner

METHOD AND APPARATUS FOR CONTROLLING INK CURING

CROSS-REFERENCE TO RELATED APPLICATION

This application is a U.S. National Stage Application of and claims priority to International Patent Application No. PCT/EP2013/051482, filed on Jan. 25, 2013, and entitled "METHOD AND APPARATUS FOR CONTROLLING INK CURING," which is hereby incorporated by reference in its entirety.

BACKGROUND

Inkjet printing processes are used to produce a printed image on a surface of a print medium. During inkjet printing, ink drops or other printing fluids are generally ejected from a nozzle of a printhead at high speed by an inkjet printing system and are deposited onto the print medium to produce the printed image on the surface thereof. For certain applications, high-quality and durable inks are required. For example, outdoor applications such as event banners and transit signage as well as high-quality indoor signage may require these properties. To address this, pigmented, water-based inks using aqueous-dispersed polymers have been developed. For example, Hewlett-Packard Company of Palo Alto, Calif. supplies a range of 'Latex Inks'. These inks, as well as others, require a curing process. For pigmented, water-based inks with aqueous-dispersed polymers a curing process evaporates an ink vehicle causing latex polymer particles within the ink vehicle to coalesce to form a continuous polymer layer that adheres to print media and encapsulates a pigment that is also carried by the ink vehicle to form a durable colorant film.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

In the following description, for purposes of explanation, numerous specific details are set forth in order to provide a thorough understanding of the present apparatus and method. It will be apparent, however, to one skilled in the art that the present apparatus and methods may be practiced without these specific details. Reference in the specification to "an example" or similar language means that a particular feature, structure, or characteristic described in connection with the example is included in at least that one example, but not necessarily in other examples.

Figure 1A:
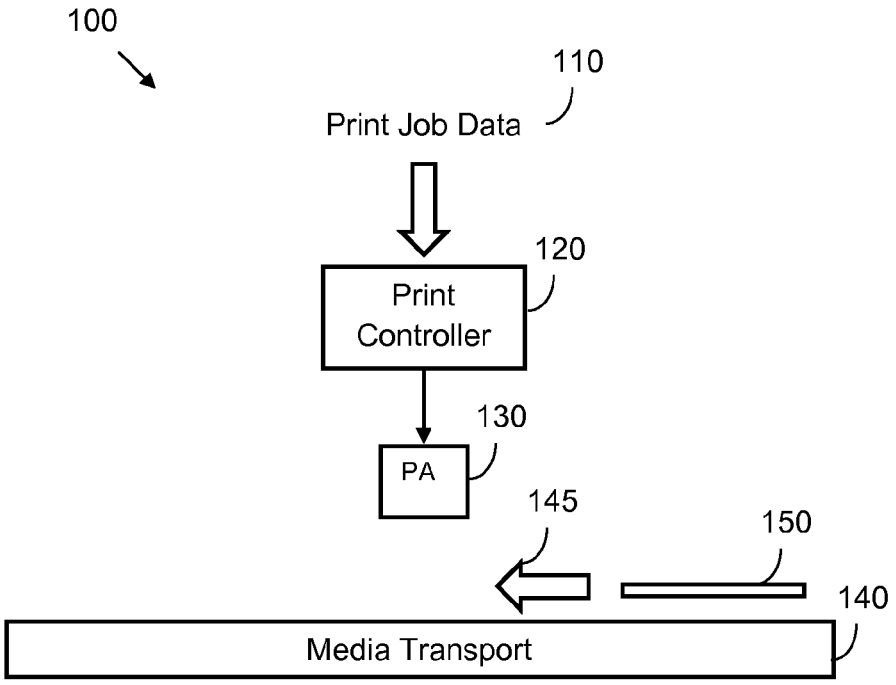
FIG. 1A is a schematic illustration showing a first view of a printing device according to a comparative example.

A comparative example of a printing device 100 is shown in FIG. 1A. FIG. 1A, as well as other Figures referenced herein, is a schematic diagram, as such certain components have been omitted to facilitate a description of certain examples and actual implementations may vary in practice. In the printing system 100, print job data 110 is received by a print controller 120. The print job data 110 may comprise image and/or control data associated with a document to be printed, e.g. one or more data files representing an image with a width and a height that comprises a plurality of pixel values. The print job data 110 may be generated by a print workflow manager (not shown) on receipt of a new print job. The new print job may be received, amongst others, in one case from a user of a computer system or in another case from a memory device such as a universal serial bus (USB) device communicatively coupled to the printer). It may comprise digital and/or analog data. The print controller 120 processes the print job data 110 and accordingly controls a printing arrangement 130. The printing arrangement 130 deposits one or more inks onto a print medium 150. In the present example, the print medium 150 is carried under the printing arrangement 130 by a media transport 140. The printing arrangement 130 may be vertically and/or horizontally spaced from the print medium 150, depending on the implementation. A vertically-spaced arrangement is shown in FIG. 1A for ease of explanation. The media transport 140 moves the print medium 150 in direction 145 incrementally such that successive portions of an image may be printed. With reference to direction 145, "downstream" in the examples herein indicates in a direction of portions of the print medium that have had been the subject of printing (e.g. as shown by arrow 245) and "upstream" indicates in a direction of portions of the print medium have yet to be printed upon (e.g. in the opposite sense to arrow 245).

Figure 1B:
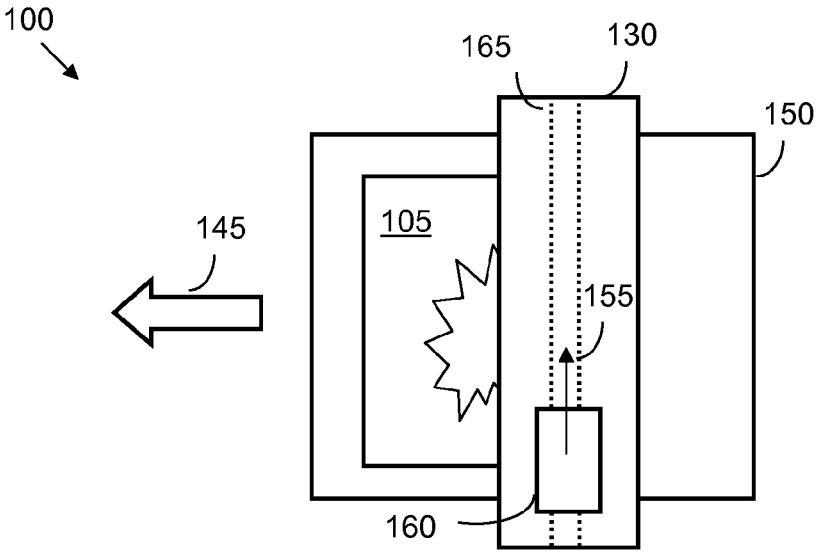
FIG. 1B is a schematic illustration showing a second view of a printing device according to a comparative example.

As shown in FIG. 1B, in this comparative example, the print arrangement 130 comprises a moveable carriage 160 that moves across a width of the print medium 150 in direction 155. In this example, the width of the print medium 150 is aligned with a width of an image to be printed. In FIG. 1B the moveable carriage 160 is mounted on guides 165 that may comprise tracks or rails. In a printing operation the print medium 150 is incrementally moved beneath the printing arrangement 130. During its residence beneath the printing arrangement 130, the moveable carriage scans across the width of the print medium in direction 155 to deposit one or more swaths of ink. In the printing operation, a plurality of swaths are deposited with a relative movement of the print medium in relation to the printing arrangement 130 being effected between successive swaths. Over time, a plurality of swaths forms a printed image 105. In certain examples one or more printheads are removably mountable in the moveable carriage 160, and as such the moveable carriage comprises one or more printhead interfaces arranged to receive said printheads. A printhead interface in this case comprises an electrically coupling that enables image and print control data to be sent to a printhead to control nozzle firing.

Figure 2A:
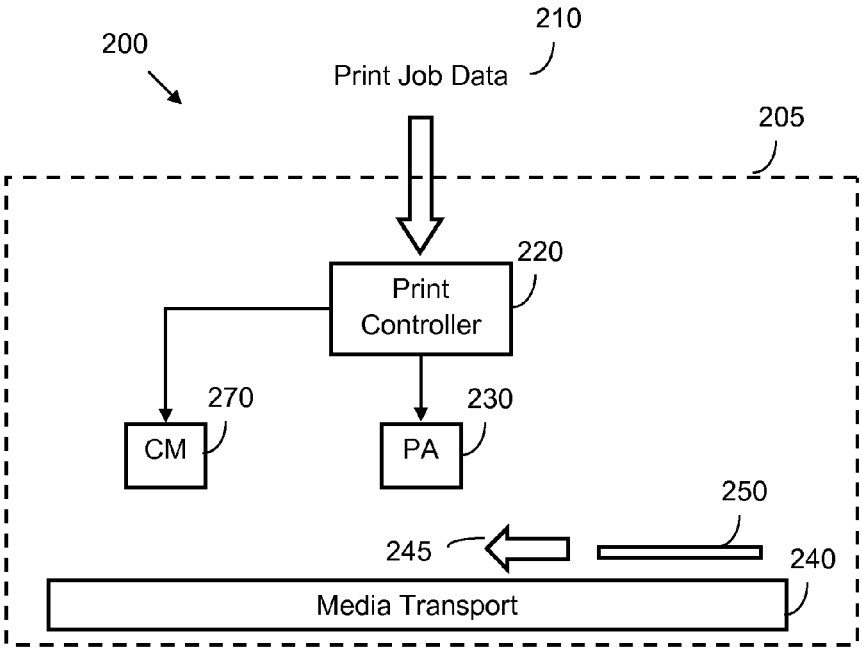
FIG. 2A is a schematic illustration showing a first view of a printing device with a curing module according to an example.
Figure 2B:
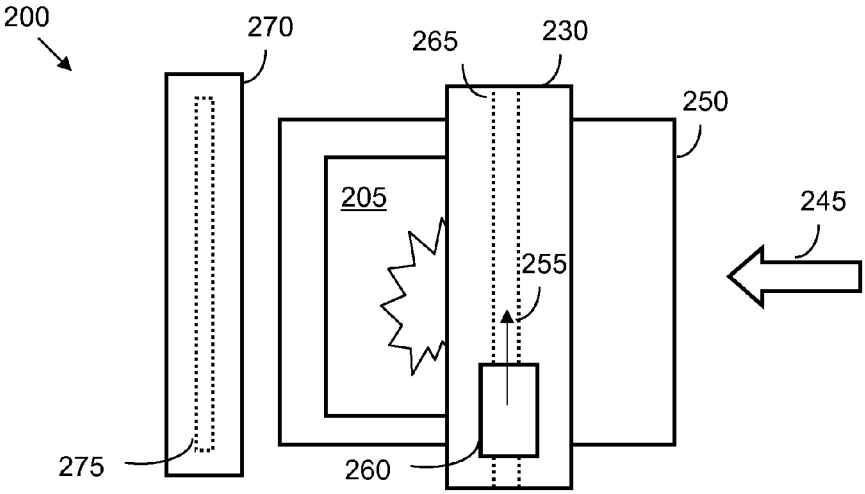
FIG. 2B is a schematic illustration showing a second view of a printing device with a curing module according to an example.

FIGS. 2A and 2B show an example of a printing system 200 that is similar to printing system 100 and arranged to deposit an ink that requires a curing process. The printing system 200 comprises at least a printing device 205 arranged to receive print job data 210. The printing device 205 comprises at least a print controller 220, a print arrangement 230 and a curing module 270. A media transport is also used to transport a print medium 250 in direction 245. In a similar manner to FIG. 1A, the print controller 220 receives print job data 210 and controls the print arrangement 230. The print controller 220 generates image and print control data for an image using the print job data 210. In use, the print controller 220 generates image and print control data for a plurality of swaths that are used to print an image. In one case, the print controller 220 pre-generates image and print control data for a plurality of swaths before one or more swaths are printed, e.g. decomposes an image represented in the print job data 210 into a series of swaths (e.g. image strips) that have a width corresponding to a width of the image and a height according to a useable nozzle height of at least printhead of the print arrangement 230. In another case, the print controller 220 generates image and print control data for a set of one or more swaths at a time, e.g. based on a stream of print job data 210, image and print control data for a second set of one or more swaths is generated as a first set of one or more swaths is printed. Either case is applicable to the methods and apparatus described herein. In either case, at least image and print control data for one or more swaths is sent to the print arrangement 230. FIG. 2B shows a printed image 205 that is being incrementally printed as at least one moveable carriage 260 sweeps or scans across a width of the print medium 250 in direction 255. As the moveable carriage 260 moves on guides 265 in direction 255 ink is deposited on the print medium 250 according to the image and print control data. After one or more passes of the moveable carriage 260 the print medium is moved in direction 245 by the media transport 240.

The curing module 270 is arranged downstream of the print arrangement 230 such that, during a print operation, a portion of the print medium 250 comprising at least a portion of a printed image 205 moves from the print arrangement 230 to the curing module 270 in direction 245. As shown in FIG. 2B the curing module 270 comprises one or more heating components 275 that are arranged to cure ink that has been deposited on the print medium 250 as part of the printed image 205. As shown in FIG. 2A, in the present example the curing module 270 is communicatively coupled to the print controller 220. The curing module 270 is then arranged to receive image and print control data for at least one swath from the print controller 220 and use this data to control one or more operating parameters of the one or more heating components. In the present example the curing module 270 forms part of the printing device 205. In certain cases one or more heating components of a curing module may be mounted on or near the moveable carriage 260, either as well as or instead of the curing module 270 as shown in FIGS. 2A and 2B. In these cases the curing module and printing module may form part of a common print arrangement, wherein the curing module is arranged to cure or part-cure after printing.

Before the control applied by the curing module is described in more detail, a description of an example curing process will be described with reference to FIGS. 3A to 3D. It is to be understood that FIGS. 3A to 3D are not to scale and are provided as an example to ease explanation of the present invention, other ink and media types with different curing processes may alternatively be used. For example, as well as or instead of the example described below an ultra-violet curing process may be used.

Figure 3A:
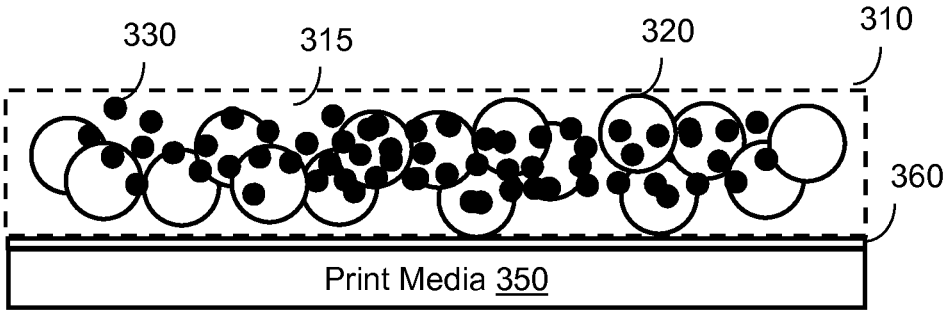
FIGS. 3A to 3D are schematic illustrations showing the curing of ink according to an example.

FIG. 3A shows a schematic drawing of a liquid film of ink 310 that is deposited on the surface of a nonabsorbent print media 350, such as uncoated vinyl. When the print media 350 comprises uncoated vinyl it may be prepared to have a layer of softened vinyl 360 for the deposit of ink. The liquid film 310 is deposited in a print zone of a print medium, which is a region of a printing device where ink drops are jetted onto the print media that is located immediately under one or more scanning printheads. For example, the print zone may comprise the area underneath print arrangement 230. In this case, the layer of liquid film 310 comprises a mixture of an ink vehicle 315, latex polymer particles 320, and pigment particles 330. This layer is created from an ink droplet after a wetting agent, a humectant, and additives in the ink vehicle 315 wet the surface to allow the droplet to spread.

Figure 3B:
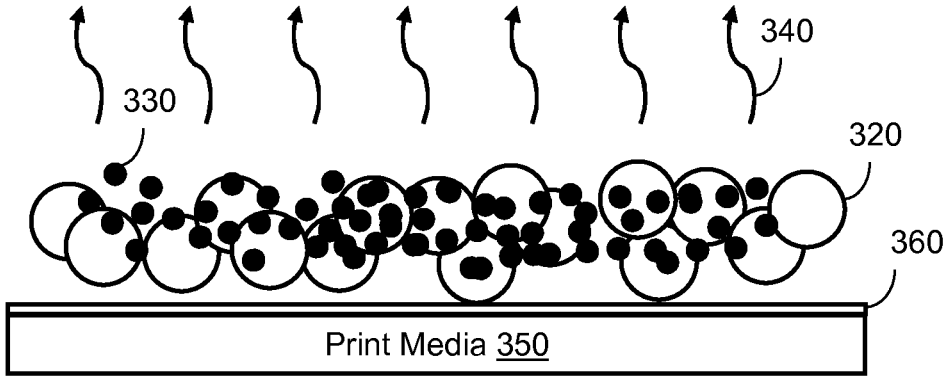

FIG. 3B shows the effect of a first stage heating process. This may be a first stage of a curing process and/or applied within the print zone. In FIG. 3B, radiant heat and forced airflow generated by one or more heating components evaporate most of the water in the ink vehicle 315, as shown by arrows 340. During this process the liquid film condenses to a viscous mixture of wetting agent and humectant (not shown), latex polymer particles 320, and pigment particles 330. The wetting agent and humectant are concentrated to prepare the vinyl surface 360 for chemical interaction with the latex polymers within the ink. A high viscosity in the ink film now immobilizes the polymers and colorant. This sets the dot size of a printed output and minimizes coalescence and bleed with dots in neighboring print locations. Chemical interactions between the surface of the media 360 and the latex polymer particles 320 bind the latex to the print media 350 to produce a durable colorant layer. With certain ink technologies that, for example, use an optimiser ink, the drying of FIG. 3B may not be applied, or may be incorporated into a curing process. An optimiser may comprise a water-based vehicle with a cationic polymer. In this case the cationic polymer is configured to increase in viscosity when different color pigments collide. This at least minimises, and in certain cases avoids, the application of heat to obtain a proper rheological (i.e. flow) behavior. In certain cases the vehicle comprises other components like surfactants, dispersants, etc.

Figure 3C:
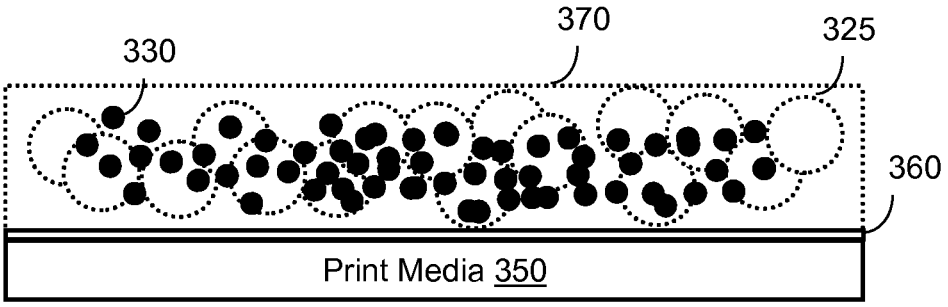

FIG. 3C shows the print media as it enters a curing zone comprising one or more heating components, for example, one or more heating components 275 of curing module 270. If the drying shown in FIG. 3B is not used, or forms part of the curing process, FIG. 3B may alternatively represent the print media as it enters the curing zone. In the curing zone a process of film formation takes place. This may use higher operating temperatures than an ink drying process. This process of film formation is called "curing", and it occurs during and after the wetting agent and humectant evaporate ("drying"). In the curing process the one or more heating components evaporate the wetting agent and humectant. During this process, the latex polymer particles 325 coalesce into a continuous polymer film 370 that encapsulates the pigments 330. This continuous polymer film then chemically bonds to the vinyl surface 360.

Figure 3D:
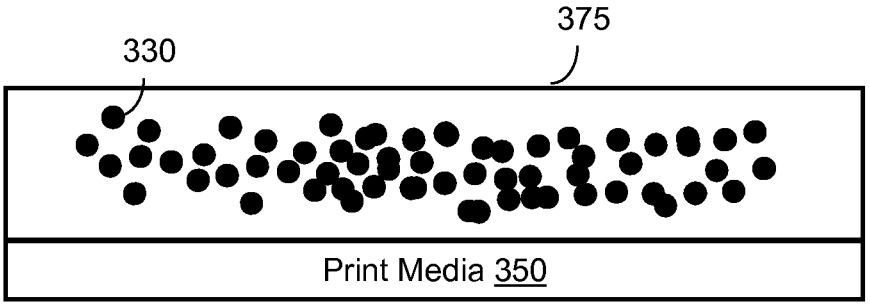

FIG. 3D shows a cured film of ink. After curing, a continuous latex film 375 is present on the print media 350 that encapsulates the pigments 330. No additional drying of the printed output is needed because the ink vehicle has evaporated. An external print dryer is not needed. A printed output emerges from a printing device, such as device 200 in FIGS. 2A and 2B, ready to use and/or finish (e.g., trim, weld, or laminate).

In certain examples described herein a predictive control strategy is employed to control one or more heating components of a curing module. This control strategy uses information supplied from a print controller, such as image and print data from print controller 220 in FIG. 2A, to control one or more operating parameters of the one or more heating components. This information is supplied at the time of, or shortly following, print and comprises actual data used to produce a printed output from a print arrangement, such as print arrangement 230 of FIGS. 2A and 2B. This is made possible by a communicative coupling between a print controller and the curing module, as for example shown in FIG. 2A. The information supplied from the print controller can be used before a particular portion of a printed image enters the curing module to determine at least an appropriate curing temperature for said particular portion. This in effect allows the required operating parameters of the curing module to be predicted implementing a feed-forward control process. In some examples, this process may be applied together with reactive feed-back control processes.

Figure 4:
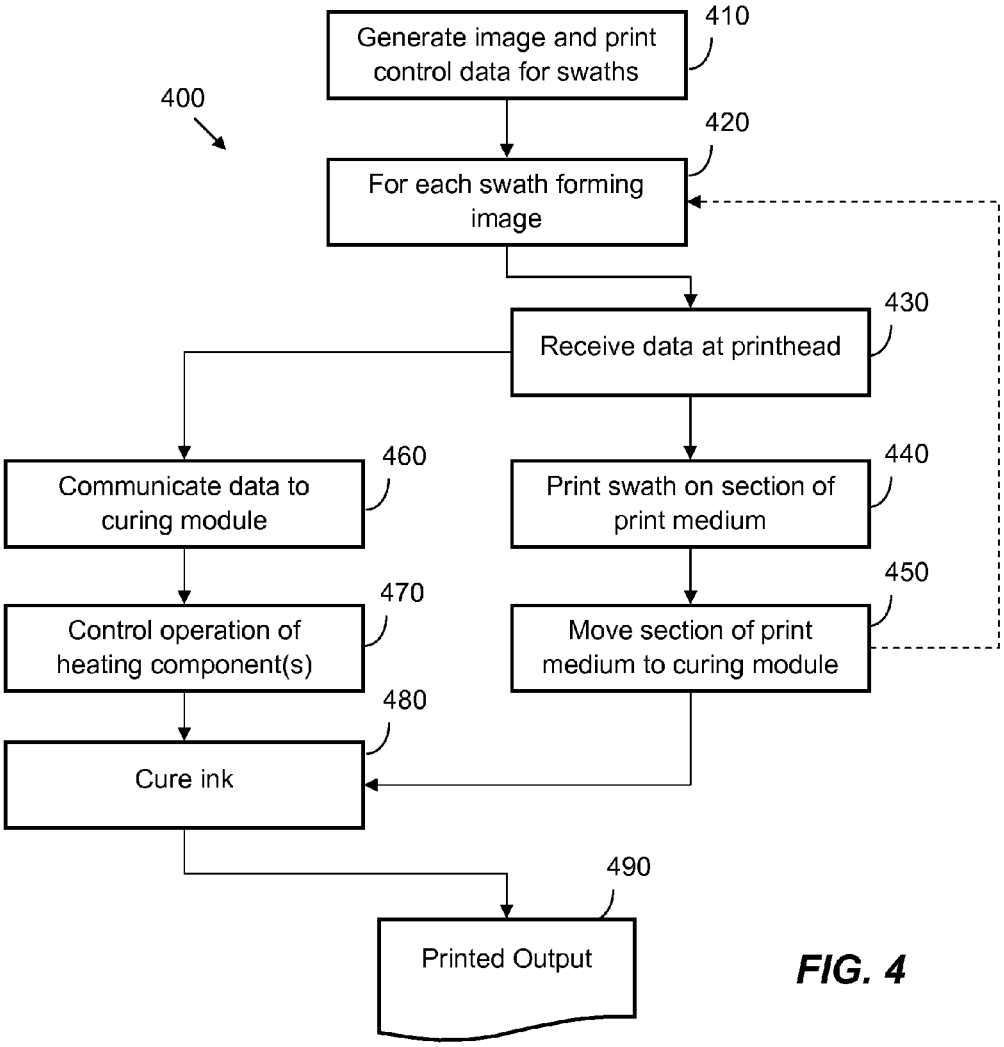
FIG. 4 is a flowchart showing a method for controlling ink curing according to an example.

FIG. 4 shows a method 400 of controlling a curing process according to an example. At block 410 image and print control data for one or more swaths is generated, for example by a print controller such as 220 in FIG. 2A. During the printing operation image and print control data is generated for all swaths making up an image; however, this data may be prepared prior to print of all swaths or prior to print of certain subsequent swaths. At block 420, a particular set of one or more swaths are selected. This example will assume that the method 400 operates one swath at a time; however, other examples may operate on a set of two or more swaths at a time. At block 430 image and print control data is received at one or more printheads, for example such as those forming part of print arrangement 230 in FIGS. 2A and 2B. The image and print control data is then used to print at least a swath of an image on a section of a print medium at block 440. The section of the print medium may be a strip across the width of the print medium. After the swath has been printed the section of print medium is moved, for example by the media transport 240 of FIG. 2A towards a curing module, such as curing module 270 in FIGS. 2A and 2B.

In parallel with blocks 440 and 450, image and print control data is communicated to the curing module at block 460. This occurs at a time following the generation of the image and print control data for a swath but before the same swath in printed form arrives at the curing module. In the example of FIG. 4, image and print control data is communicated to the curing module at the time a swath is printed, which in practice may be a short time before, during or after the printing of the swath. At block 470 operation of the heating components within the curing module is controlled based on the communicated image and print control data. This may comprise setting a temperature and/or airflow characteristics of one or more heating components such that a heating component supplies a predefined amount of energy when the section of the print medium arrives at the curing module. At block 480 the section of the print medium arrives at the curing module and the ink is cured based on the controlled operating parameters of the one or more heating components within the curing module. This then produces at least a section of a completed printed output 490.

As shown in FIG. 4, after a particular swath is printed on a particular section of a print medium, blocks 420 to 480 may be repeated for subsequent swaths and corresponding subsequent sections of the print medium. In this way the control strategy is continuous for a plurality of swaths that comprise an image. The control strategy is also dynamic as the values for the image and print control data may change for each swath.

The image data may comprise data that is based on an image to be printed, e.g. pixel values and/or nozzle firing data for a swath to be printed. The print control data may comprise one or more printing parameters for the swath, such as one or more of at least: a print medium identifier that identifies at least a type of the print medium for the current print and a print medium profile that indicates one or more properties of the print medium, such as media width, media dependent temperatures, media absorbency etc. The one or more printing parameters may comprise parameters that change in value during a printing operation; in which case, print control data for a swath may comprise values for these parameters at a time a particular swath is printed and/or values for these parameters at a time when the parameters are communicated to a curing module. For example, these parameters may be one or more of at least: one or more print speeds for the printing device; one or more delay parameters that indicate whether any time delays have occurred during the printing process; an operating temperature and/or other temperature settings for the printing device; and airflow parameters that indicate one or more airflow characteristics within the printing device. The delay parameters may, for example, comprise delays, if any exist, due to intermediate servicing routines and/or inter-pass-delays, including variable inter-pass delays to allow for better image quality in worst-case printing scenarios. One or more print speeds may comprise a horizontal print speed such as a total time for a moveable carriage to print a swath, for example a time for moveable carriage 260 in FIG. 2B to print a swath in direction 155. This horizontal print speed may include any delays introduced into the printing of a swath. One or more print speeds may also comprise a vertical print speed, e.g. a speed in direction 245 in FIGS. 2A and 2B, which may be linked to the number of passes of a moveable carriage (e.g. 260) and a media advance speed, e.g. a speed set by a media transport such as 240 in FIGS. 2A and 2B. In certain cases ink density measurements may be based on a combination of image data and print control data. For example, ink density may be associated with, e.g. determined based on, the number of passes of a moveable carriage, media type and characteristics, image content etc. There may be multiple temperature and/or airflow parameters in the printing device, wherein not all of these may directly influence the printing process (e.g. they may relate to ventilation or safety aspects). Certain ones of these parameters may still, however, influence a curing process. These parameters may be predetermined, measured and/or dynamically controlled.

Both the image data and print control data may be dynamic. Image data will typically vary for each swath to be printed dependent on variation in an underlying image to be printed. Print control data may vary as properties of the printing device change during a print operation. For example, if a printing operation involves the printing of two images on two separate print media, such as vinyl and textile, then this is reflected in different print control data for swaths to be printed on the vinyl print medium than for swaths to be printed on the textile print medium, as the print medium is taken into account when the image and print control data is generated at block 410. In this example, a print media parameter within the print control data is used to select an appropriate operating temperature for a particular swath automatically without any additional input or configuration from a user. Likewise if delays occur between the printing of a first swath and a second swath, this may be communicated to the curing module as part of current print control data for the second swath. The curing module may then delay the setting of a temperature dependent on the communicated delay parameter. Again this occurs automatically.

Figure 5:
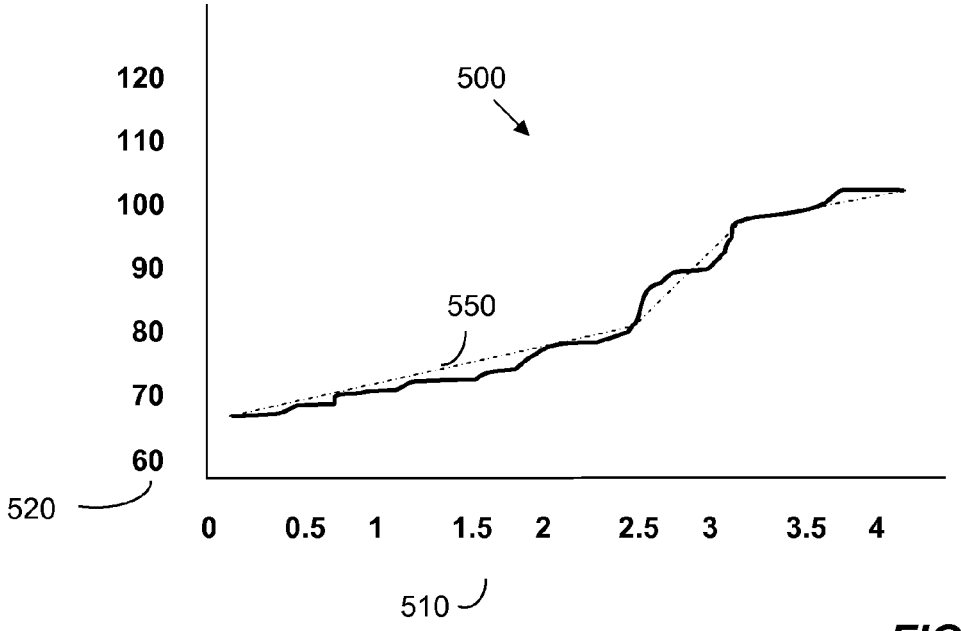
FIG. 5 is a chart showing how a curing temperature varies with ink density according to an example.

FIG. 5 shows an example of an ink-temperature curve 500 for a given print media type and print mode. The x-axis 510 shows a number of drops per pixel for a particular dots-per-inch (DPI) resolution. Values on the x-axis represent a particular ink density on the print medium and may be derived from at least one or more of image data and print control data for a swath or portion of a swath. The y-axis 520 shows a temperature in degrees Celsius. This temperature is a temperature required for a correct curing of an ink, for example a curing process as shown in FIGS. 3A to 3D. The example shown is for a bi-directional print mode with 6 passes, i.e. involving the deposit of ink from a moveable carriage while the carriage moves across the width of a print medium in two directions six times. A value of 1 on the x-axis may relate to a value for a lightly coloured or low-density printed image, a value of 2.5 may relate to a value for a printed image with medium coverage, and a value of 3.25 may relate to a value for a printed image with dense colour coverage.

In a basic case, the ink-temperature curve 500 of FIG. 5 may be represented by a look-up table wherein temperature values are indexed based on an ink density measurement. In more complex examples, a multidimensional mapping may be implemented that maps a plurality of input values to one or more operating parameters of a heating component. These one or more operating parameters may have an accompanying time value, for example representing a target temperature value at a target time or time offset. The plurality of input values may comprise an ink density measurement and one or more of: a print mode, a DPI value, a print media identifier, a number of passes etc. For example, the ink-temperature curve 500 of FIG. 5 may be retrieved based on print parameter values of: print_mode=BIDIR (i.e. bi-direction); passes=6; DPI=600; and media_type=SELF_ADHESIVE_SHEET. In this example, an ink density measurement for a particular portion of a swath is then used to retrieve a temperature based on the relationship depicted by the ink-temperature curve 500. Other curves may then be retrieved for different print parameter values (or ranges of values). Alternatively, a function may be derived that takes at least one print parameter and ink density measurement as an input and outputs a temperature and/or other operating parameter.

Figure 6:
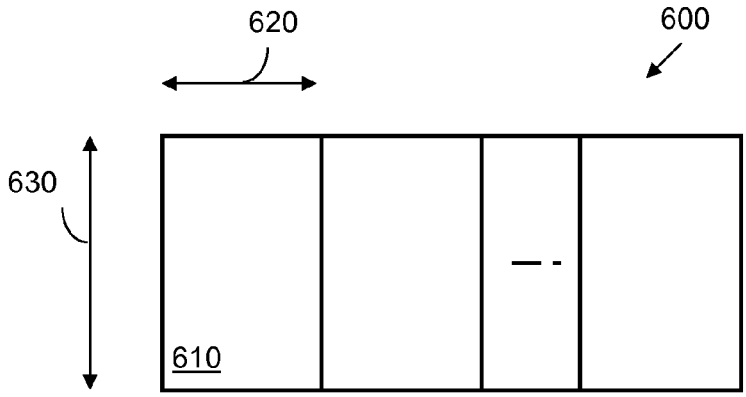
FIG. 6 is a schematic diagram showing how ink density may be measured for a swath according to an example.

FIG. 6 shows a schematic representation of a swath 600 to demonstrate how an ink density measurement may be calculated based on image and print control data according to an example. The example swath of FIG. 6 extends across the width of an image to be printed on a print medium. In this example a swath 600 is split into a number of portions or regions 610. Each region 610 has a width 620 and a height 630. In the present configuration the height 630, i.e. the number of raster rows of image data, is equal to the height of the swath 600; however other examples may comprise two or more regions that extend over the height of a swath. In FIG. 6, the width of the swath 600 is spilt into a plurality of regions 610 with width 620, which may be the same for all regions. In certain examples, the region width 620 is programmable and can be set to 64, 128, 256 or 512 pixels. As such the number of regions 610 may vary depending on the length of a swath.

In the present example, a print controller, such as print controller 220 of FIG. 2, is arranged to determine an ink density measurement using data structures corresponding to those shown in FIG. 6. In this case, an ink density measurement is calculated for each region 610 based on image data for a swath. One example of how this may be achieved is described below.

In one printing process, a print controller implements functions of a print data pipeline, wherein a print data pipeline is a command or process chain effected on received print job data, wherein an output of one program or algorithm is used as an input of another. For example, such a print data pipeline may involve controlling the operation of a drive motor and a pick roller motor that form part of a media transport and regulating the supply of print medium to and through a print zone of a printing device. Furthermore, the data pipeline may involve modifying the received print job data, allocating portions of the print job data to various printheads and producing commands for firing pulses that are sent to said printheads. In one case, the print controller may implement one or more of replication, linearization and half-tone processing for received print job data. The replication processing is used to replicate or copy image data contained in the print job data for further image plane processing, for example for different colours and/or surface treatments. The linearization processing is used to linearise or standardise pixel levels, for example in an ink plane. The half-tone processing is used to reduce or otherwise vary the size or density of the dots emitted by a printhead to create printing shades. In one case a matrix half-tone algorithm is used to transform an N-bit word of pixel data for printing into one or more "hifipe" bits that are used to control the printing of a half-tone pattern. One of the functions of the print controller in this case may be a "density counting" function that counts the number of times a particular "hifipe" value or level occurs in a swath region 610. The output of this function is then a count value for each "hifipe" value or level region. These count values are representative of the amount of ink that will be printed on a section of a print medium corresponding to a particular swath region 610. They may thus be accessible to a curing module as image and print control data representing an ink density measurement. As such the count values, or an output of a function of the count values, may be used as an input to a temperature mapping function similar to that shown in FIG. 5.

As will be understood, other functions and processes implemented by a print controller may be used to obtain an ink density measurement. For example, these functions and processes may depend on the type of printing device that is being used and may differ for other types of device. Ink density measurement values may be supplied by a print controller, for example in response to an programming function call, or may be retrieved from memory accessible by a curing module, for example these may comprise values that are calculated as part of a printing process, even if a curing process is not required.

Figure 7A:
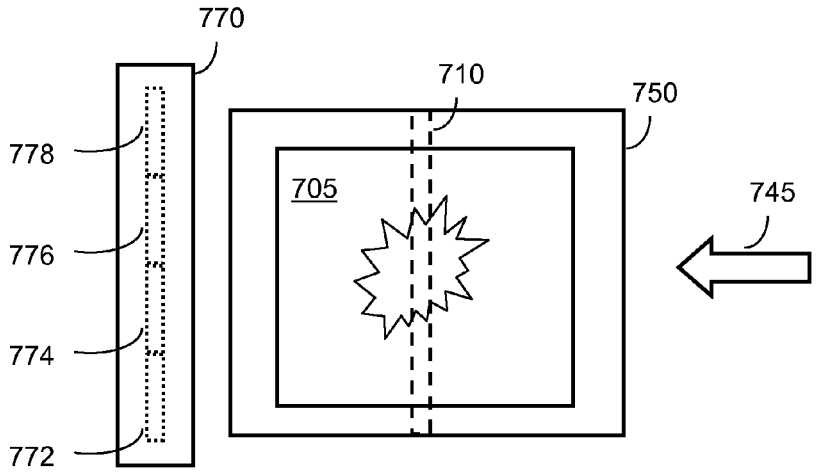
FIG. 7A is a schematic diagram showing a curing module with a plurality of heating components according to an example.

FIG. 7A shows an example wherein a curing module 770 comprises a plurality of controllable heating components that are distributed across a width of a print medium 750, i.e. in a direction perpendicular to a media transport direction 745. In FIG. 7A, four heating components are shown: a first heating component 772, a second heating component 774, a third heating component 776 and a fourth heating component 778.

Figure 7B:
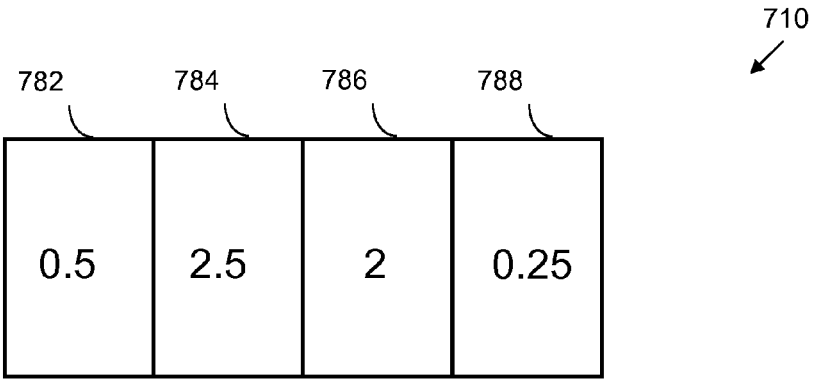
FIG. 7B is a schematic diagram showing example image density measurements for a swath to be printed.

FIG. 7A shows an exemplary swath 710 that forms part of image 705. A representation of the swath 710 is then further shown in FIG. 7B. FIG. 7B shows four regions 782 to 788 of the swath 710. An ink density value is determined for each region: in this example the values are 0.5, 2.5, 2 and 0.25 as shown in the Figure. These represent a change in ink density across a width or scan axis of a print medium, with the centre of the image having a higher ink density than the periphery. Each of these ink density measurements 782 to 788 may be mapped to an operating parameter based on image and print data, for example as described above. If the print data signifies print parameters corresponding to the case illustrated in FIG. 5, the ink density values may represent a number of drops per pixel that can be mapped to a temperature on the y-axis 520 of FIG. 5. Alternatively, or as well as, a temperature value, the ink density values may also be mapped to controllable airflow parameters of each heating component, such as a fan speed. For example, the ink density value in region 782 (0.5) may be mapped to a temperature of 71 degrees Celsius and a fan speed of 20% for heating component 772, whereas the ink density value in region 786 (2) may be mapped to a temperature of 80 degrees Celsius and a fan speed of 45% for heating component 776. Based on print parameters comprising any delays and/or other media transport parameters there operating parameters may be mapped to a time of arrival of a section of the print medium corresponding to swath 710 at the curing module 770. For example, if the image and print data is communicated on print of a swath the operating parameters may have a corresponding time or time offset for application, e.g. (80, 45, 13:39:01) or (80, 45, 00:02:33). These operating parameters may be supplied to existing feedback routines as target values for a particular time.

Certain examples described herein allow a quantity of ink deposited on a print medium to be determined based on image and print control data from a print controller. As shown in FIGS. 7A and 7B, information generated by a print controller may be used to determine the number of ink drops fired in each of a plurality of regions along a scan axis, i.e. across the width of a printed image, and in each of a plurality of swaths along a media transport direction, i.e. along a height of a printed image. This enables one or more operating parameters of a curing module to be controlled based on a two-dimension representation of a printed image. In effect, it enables the amount of energy to be applied by the curing module to also be determined in two-dimensions, i.e. across both a width and height of a printed image. For example, for a swath, operating parameters to provide a given amount of energy may be given for incremental sections of "x" units (e.g. "x" centimeters or inches) along a scan axis and they may be dependent on the number of passes of a moveable carriage. Certain examples described herein, enable energy to be differentially applied in a direction parallel to a scan or swath axis as well as enabling the prediction of energy values for movement in a media transport or paper axis. As the examples base control on data for sets of one or more swaths that is generated by a print controller, i.e. the same data that is used to instruct the print of said swaths, they are able to accommodate dynamic changes in print parameters during a printing operation. As each set of swaths are printed the image and print control data is continuously updated to accurately control the curing process.

A relationship between image and print control data generated by a print controller and one or more operating parameters of a curing module may be experimentally and/or theoretically modeled. In one case, this may be achieved by starting with a maximum level of temperature that coincides with a maximum amount of ink that may be deposited in a swath region for a given printmode and a given print media. This may first be determined for a first printmode that uses a maximum nozzle firing frequency of one or more printheads (e.g. a "most demanding" printmode). A minimum temperature may also be determined that may represent a temperature that can be withstood by unprinted media without damage. Data points between this maximum and minimum may then be modeled and/or plotted to construct a mapping curve. This curve may be an approximation and may comprise one or more linear sections for easy implementation, as illustrated by mapped modeled relationship 550 in FIG. 5. In certain cases a relationship between the curves for different printmodes may be constructed, e.g. a second printmode may require a reduction in temperature of 10% as compared to said first printmode.

By controlling operating parameters across a scan axis, as for example shown in FIGS. 7A and 7B, different amounts of curing energy may be applied across the width of a printed image. This may be of benefit when bi-directional printmodes are used. In these printmodes a "drop-on-top-of-another-drop-time" may differ along the scan axis, such as between both sides and the center of a printed swath. For example, a first drop may be deposited corresponding to a pixel at the start of a swath in direction 255 of FIG. 2B and a second drop for the same pixel may not be again deposited on top of the first drop until a moveable carriage has moved to the far side of the print arrangement 230 and back. This may be compared to a first drop that is deposited at the far side of the print arrangement (i.e. towards the top of FIG. 2B). For this latter first drop there will only be a relatively short delay while the moveable carriage changes direction and returns in a direction opposite to direction 255. This may result in one drop that is deposited on a relatively dry previous drop and one drop that is deposited on a relatively wet previous drop. To address this, in one variation, a curing energy profile is applied across a swath that modulates operating parameters for independently-controllable heating components distributed across the width of the print medium. For example, an airflow (e.g. fan) parameter and/or temperature may be increased for printed regions at the far end of the swath (e.g. effectively "ramping" or modulating determined operating parameters along the swath). This can reduce and/or avoid uneven drying or curing, in turn reducing and/or avoiding deficiencies in image quality, such as differences in graininess and/or luminance, and banding.

Certain examples described herein apply predictive curing control that is continuous and can adapt to changes in print conditions. This may have a benefit in the form of reduced and/or avoided image quality defects. It may also allow better control of the energy applied within a curing module. For example, the energy applied may be more accurately mapped to image and print control data for a printing operation, which in turn may reduce energy consumption and cost per print copy. For example, curing of an internal draft print with large blank spaces may be controlled to use less energy than a densely-illustrated outdoor high-quality colour print, as compared to a previous case wherein a constant high temperature may have been used for both prints. Better control may also reduce and/or avoid print media damage, as applied curing energy may be reduced for unprinted or low-density regions.

As described previously, the apparatus and methods described herein may be used to complement feedback (e.g. reactive) control procedures. These control procedures may use one or more values from temperature sensors in and/or near (e.g. opposite) a curing module to maintain a supplied temperature value in a closed loop. Any change in temperature detected based on information supplied by said sensors may be used to control one or more servos and/or operating parameters to maintain said supplied temperature value. In a variation where these feedback control procedures are also used, one or more supplied target values to be achieved at a particular time may be set by the predictive control procedures described above. For example, at the beginning of a printed image there may be a step change in ink amount on a print medium. According to the predictive control procedures described above, this change will be indicated in image and print control data supplied by a print controller before the corresponding section of the printed image arrives at the curing module. A target temperature and/or one or more other operating parameters of the curing module may thus be set in advance so that the target temperature is achieved by the time the corresponding section of the printed image does arrive at the curing module.

Certain examples described herein avoid the need for a user to program an external curing device. For example, a user need not program, supply and/or select parameters such as speed of the printmode used, width of the print media, ink and/or color etc. In the present examples, parameters such as these are accessible to the curing module based on its coupling with the print controller and so the curing module uses these parameters to automatically adjust one or more operating parameters of one or more heating components. A continuous print operation that uses different print media and different speeds is further possible; there is no need to interrupt the operation to change external device values. This allows, for example, a continuous print operation in a double roll printer system that comprises one roll of vinyl print media and one roll of textile print media, wherein two different large images may be printed at different speeds, with different saturations on the different media. As information is supplied from the print controller, i.e. "downstream" in a processing pipeline many of the variations in conditions are implicitly represented in generated image and print control data.

At least some aspects of the examples described herein with reference to the drawings may be implemented using computer processes operating in processing systems or processors. For example, a print module and/or a curing module may comprise an embedded processor arranged to implement a set of computer program code stored in a memory, such as a reduced instruction set code. These aspects may also be extended to computer programs, particularly computer programs on or in a carrier, adapted for putting the aspects into practice. The program may be in the form of non-transitory source code, object code, a code intermediate source and object code such as in partially compiled form, or in any other non-transitory form suitable for use in the implementation of processes according to the invention. The carrier may be any entity or device capable of carrying the program. For example, the carrier may comprise a storage medium, such as a solid-state drive (SSD) or other semiconductor-based RAM; a ROM, for example a semiconductor ROM; a magnetic recording medium, for example a hard disk; etc.

Similarly, it will be understood that any print controller referred to herein, for example all or part of print controller 220 in FIG. 2A may in practice be provided by a single chip or integrated circuit or plural chips or integrated circuits, optionally provided as a chipset, an application-specific integrated circuit (ASIC), field-programmable gate array (FPGA), etc. This may apply to other printer control circuitry, such as that used in a curing module. The chip or chips may comprise circuitry (as well as possibly firmware) for embodying at least a data processor or processors as described above, which are configurable so as to operate in accordance with the described examples. In this regard, the described examples may be implemented at least in part by computer software stored in (non-transitory) memory and executable by the processor, or by hardware, or by a combination of tangibly stored software and hardware (and tangibly stored firmware).

The preceding description has been presented only to illustrate and describe examples of the principles described. In certain Figures similar sets of reference numerals have been used to ease comparison of similar and/or comparative features. Variations may use a print zone heating component that may be controlled similarly to the curing module described in particular examples herein, for example one or more heating components may be installed as part of print arrangement 230. Even though an example with a moveable carriage has been described the examples herein may equally be applied to "web-printing" or page-wide array devices that comprise a plurality of static printhead mounted across a width of a print medium. In other examples a printing device may also comprise a plurality of print arrangements that are distributed along a media transport path. Even though particular examples of ink density or quantity measurement are described, other suitable measurements may also be used in their place. Reference to a curing module controlling a function and/or receiving data may also refer to a controller associated with the curing module. Examples have been shown with one or more heating elements arranged across the width of a print medium (e.g. horizontally in the plane of a print media); in other examples (not shown) one or more heating elements may be arranged along at least a portion of a length of a print medium (e.g. vertically in the plane of a print media), as well as or instead of said one or more heating elements arranged across the width of the print medium. For example, a plurality of heating elements may be arranged in an addressable two-dimensional array, wherein control of an individual heating element "pixel" is based on image and print control data. The term print medium may refer to a discrete medium, e.g. a page of paper or material, or a continuous medium, e.g. a roll of paper or vinyl. Certain examples reflect circumstances wherein printheads are installed, for use, in a printing device. A controller as described herein may also form part of a printing device that does not comprise printheads, for example as may be the case during manufacture, sale or repair. Whereas reference has been made to "ink" in the described examples any other suitable printing fluid may be used. This description is not intended to be exhaustive or to limit these principles to any precise form disclosed. Many modifications and variations are possible in light of the above teaching.

The invention claimed is:

1. A printing device comprising:

a printing module comprising:

a printhead interface for receiving a printhead to print a swath of a printed image; and a print controller to generate image data and print control data for use in printing the swath by the printhead; and a curing module comprising a heating component and a processor to receive the image data and print control data and to control, for the swath before a printed region of a print medium corresponding to the swath arrives at the heating component, an operating temperature of the heating component based on a data value within the image data and a printing parameter within the print control data, the controlling of the operating temperature of the heating component comprising setting the operating temperature to a temperature higher than a temperature used to dry ink deposited by the printhead for the swath, the heating component when operated according to the controlled operating temperature to cure the ink, the curing comprising coalescing particles of the ink.

2. A printing device according to claim 1, wherein the print controller is to generate the image data and print control data comprising ink densities for respective portions of the swath, and the processor of the curing module is to control the operating temperature of the heating component based on the ink densities.

3. A printing device according to claim 1, wherein the curing module comprises a plurality of heating components, and the processor of the curing module is to:

set a first temperature of a first heating component of the plurality of heating components for a first region of the swath, and set a second, different temperature of a second heating component of the plurality of heating components for a second region of the swath.

4. A printing device according to claim 1, wherein the printing parameter within the print control data is selected from among:

a media transport speed for a media transport of the printing device;

a delay parameter that indicates whether any time delays have occurred during the printing; and an airflow parameter that indicates an airflow characteristic within the printing device, wherein the processor of the curing module is to control the operating temperature of the heating component based on one or more of the media transport speed, the delay parameter, and the airflow parameter.

5. A printing device according to claim 1, wherein, for the swath, the printing parameter has a value that represents a property of the printing device at the time the print controller instructs the printhead to print the swath.

6. A printing device according to claim 1, wherein the printing module is to deposit the ink comprising an ink vehicle, a pigment, and polymer particles, and wherein the curing comprises coalescing the polymer particles.

7. A printing device according to claim 1, wherein the printing module comprises a heating component and the printing module is to control an operating parameter of the heating component in the printing module based on the image data and print control data.

8. A printing device according to claim 1, wherein one of the printing module and the curing module is to perform drying of the ink separate from the curing.

9. A printing device according to claim 1, wherein the controlling comprises retrieving, from a look-up data structure that maps different ink densities to respective different values of the operating temperature of the heating component, a value of the operating temperature that corresponds to a given ink density included in the image data and print control data.

10. A printing device according to claim 9, wherein the print controller is to calculate the given ink density by counting a number of times that a value corresponding to printing of a pattern occurs.

11. The printing device of claim 1, wherein the printhead is to print a plurality of regions of the swath across a width of the print medium, the curing module comprising a plurality of heating components that are arranged across the width of the print medium, the processor to:

determine different data values within the image data for respective regions of the plurality of regions, and set different operating temperatures of the plurality of heating components to cure the ink in the plurality of regions at the different operating temperatures.

12. A method of controlling an ink curing process for a printing device, comprising:

receiving image and print control data including an ink density for a swath corresponding to an image to be printed on a print medium;

communicating, before a printed region of the print medium corresponding to the swath arrives at a heating component in a curing module, the image and print control data including the ink density to a controller associated with the curing module; and controlling, by the controller, an operating temperature of the heating component in the curing module to cure ink by coalescing particles of the ink deposited on the print medium, based on the image and print control data including the ink density, the controlling of the operating temperature of the heating component comprising setting the operating temperature to a curing temperature higher than a temperature used to dry the ink deposited on the print medium, and the controlling comprising retrieving, from a look-up data structure that maps different ink densities to respective different values of the operating temperature of the heating component, a value of the operating temperature that corresponds to the ink density included in the image and print control data.

13. A method according to claim 12, comprising:

printing the swath on the print medium;

setting a temperature of the heating component according to the operating temperature;

transporting the print medium along a media transport; and curing ink in the printed swath using the set temperature of the heating component.

14. A method according to claim 12, wherein the image and print control data includes a plurality of ink densities for a plurality of respective portions of the swath, the portions extending along a width of the swath; and controlling operating temperatures of a plurality of heating components in the curing module based on the plurality of ink densities for the plurality of respective portions of the swath.

15. A method according to claim 12, wherein the printing device is an inkjet printer to print the ink comprising an ink vehicle, a pigment, and polymer particles, and the curing comprises coalescing the polymer particles.

16. A method according to claim 12, further comprising:

calculating the ink density included in the image and print control data by counting a number of times that a value corresponding to printing of a pattern occurs.

17. A method according to claim 12, wherein controlling the operating temperature of the heating component in the curing module is further based on an airflow parameter that indicates a characteristic of an airflow in the printing device.

18. The method of claim 12, further comprising controlling, by the controller, an airflow parameter relating to airflow used by the curing module to cure the ink, the controlling of the airflow parameter comprising retrieving, from the look-up data structure, a value of the airflow parameter mapped to the ink density included in the image and print control data by the look-up data structure.

19. The method of claim 12, wherein the image and print control data further includes a first input value representing an operating configuration of the printing device, the look-up data structure mapping inputs comprising the different ink densities and different operating configurations of the printing device to the respective different values of the operating temperature, and wherein the retrieved value of the operating temperature corresponds to the ink density and the first input value included in the image and print control data.

20. The method of claim 19, wherein the image and print control data further includes a second input value representing a type of the print medium, the look-up data structure mapping inputs comprising the different ink densities, the different operating configurations of the printing device, and different types of print media to the respective different values of the operating temperature, and wherein the retrieved value of the operating temperature corresponds to the ink density, the first input value, and the second input value included in the image and print control data.

21. A printing device comprising:

a printhead assembly;

a print controller to generate image and print control data for a swath corresponding to an image to be printed onto a print medium by the printhead assembly; and a curing module controller to:

receive, before a printed region of the print medium corresponding to the swath arrives at a heating component of a curing module, the image and print control data from the print controller; and control a temperature of the heating component to cure ink on the print medium, based on a given ink density included in the image and print control data, the controlling comprising retrieving, from a look-up data structure that maps different ink densities to respective different temperatures of the heating component, a value of the temperature that corresponds to the given ink density included in the image and print control data.

22. The printing device of claim 21, wherein the controlling of the temperature of the heating component is further based on an airflow parameter that indicates a characteristic of an airflow in the printing device.

23. The printing device of claim 21, wherein the curing module controller is to control an airflow parameter relating to airflow used by the curing module to cure the ink, the controlling of the airflow parameter comprising retrieving, from the look-up data structure, a value of the airflow parameter mapped to the given ink density included in the image and print control data by the look-up data structure.

24. The printing device of claim 21, wherein the image and print control data further includes a first input value representing an operating configuration of the printing device, the look-up data structure mapping inputs comprising the different ink densities and different operating configurations of the printing device to the respective different values of the temperature, and wherein the retrieved value of the temperature corresponds to the given ink density and the first input value included in the image and print control data.

25. The printing device of claim 24, wherein the image and print control data further includes a second input value representing a type of the print medium, the look-up data structure mapping inputs comprising the different ink densities, the different operating configurations of the printing device, and different types of print media to the respective different values of the temperature, and wherein the retrieved value of the temperature corresponds to the given ink density, the first input value, and the second input value included in the image and print control data.

* * * * *